United States Patent [19]

Boogers

[11] 4,295,479

[45] Oct. 20, 1981

[54] METHOD AND DEVICE FOR MANUFACTURING CIGARS

[75] Inventor: Wilhelmus P. L. Boogers, Eindhoven, Netherlands

[73] Assignee: B.V. Arenco P.M.B., Best, Netherlands

[21] Appl. No.: 964,455

[22] Filed: Nov. 29, 1978

[30] Foreign Application Priority Data

Dec. 29, 1977 [NL] Netherlands ..... 7714544

[51] Int. Cl.[3] ..... A24D 1/02; A24C 1/26; A24C 1/30

[52] U.S. Cl. ..... 131/60; 131/105; 131/31; 131/36; 131/62; 131/360

[58] Field of Search ..... 131/20 R, 20 A, 31, 131/32, 36, 58, 60, 62, 66 R, 67, 77, 79, 85, 80, 86, 88, 105, 149

[56] References Cited

U.S. PATENT DOCUMENTS 3,542,038 11/1970 Hooper et al. ..... 131/149
4,128,214 12/1978 Maas ..... 131/149

*Primary Examiner*—Vincent Millin
*Attorney, Agent, or Firm*—Diller, Ramik & Wight

[57] ABSTRACT

A method and a device for the manufacture of cigars in which each bunch or filler is enveloped in a tobacco leaf portion, wherein the bunches or fillers are advanced one after the other along a given length, whilst a tobacco leaf portion is applied along at least part of said length of path in a stretched form to each advancing filler and wrapped around the same, due to the fact that the bunches or fillers are not stationary during the wrapping operation, but advanced the capacity of an overrolling unit is significantly raised.

12 Claims, 1 Drawing Figure

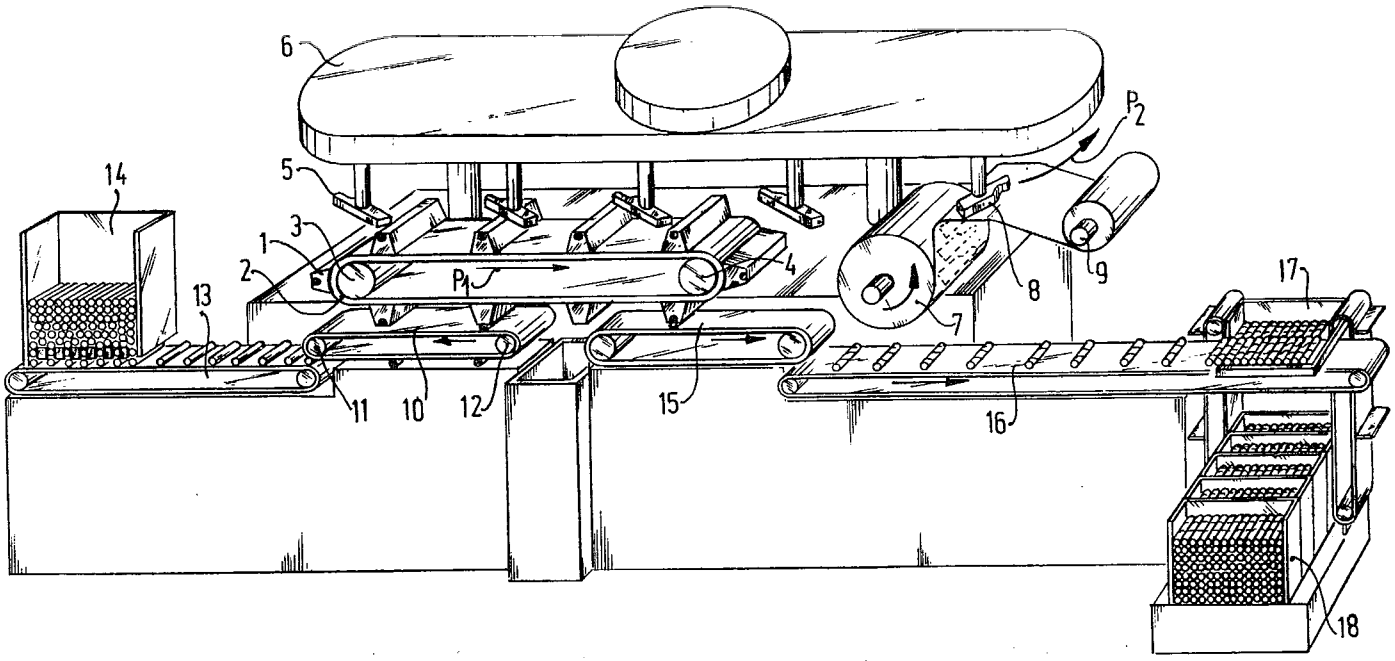
1
2
3
4
5
6
7
8
9
10
11
12
13
14
15
16
17
18
P1
P2

METHOD AND DEVICE FOR MANUFACTURING CIGARS

The invention relates to a method and to a device for the manufacture of cigars in which each bunch or filler is enveloped in a tobacco leaf portion.

In the cigar industry it is common practice to cut each wrapper from a tobacco leaf, said wrapper being subsequently picked up by a carrier, which is passed to a filler nest, in which a filler or cigar bunch has previously been arranged. At the filler nest the wrapper is applied at one end to the filler and then wound around it. Enveloping a filler with a wrapper takes about one second and it has been found that this time cannot be shortened due to the properties of the wrapper material.

In order to raise the capacity of each production unit it has been proposed to provide two filler nests. However, these units are limited in the cycle period with regard to the supply of fillers to the nests and to the transport of the wrapper by the carrier. An increase in the number of filler nests would result in a device occupying much space due to the required conveying paths.

The invention therefore proposes a completely novel method in which the aforesaid disadvantages do not occur. The method according to the invention is distinguished in that the bunches or fillers are advanced one after the other along a given length, whilst a tobacco leaf portion is applied along at least part of said length of path in a stretched form to each advancing filler and wrapped around the same.

The idea of the invention is based on the recognition of the fact that the bunches or fillers should not be stationary during the wrapping operation, but be advanced. This has the advantage that from a stock along the conveying path towards the delivery station of the ready product the fillers are rolled so that much space as well as much time are economized. Nevertheless the wrapping time remains one second.

The device for carrying out said method comprises at least two filler holders or nests serving to receive each a filler, whilst there is provided at least one leaf carrier for applying each tobacco leaf portion in a stretched state to a filler. This device is distinguished in accordance with the invention by a feeding conveyor for feeding fillers from a stock towards the adjoining transfer station, by a delivery station arranged at a distance from the former and by an advancing mechanism for carrying the filler holders from the transfer station to the delivery station and conversely as well as by a guide path with a driving mechanism for advancing at least one leaf carrier in synchronism with the holders.

An advantageous embodiment of the invention is constructed so that the holders are arranged on an endless conveying element passed around at least two reversing members, one run forming the length of the path and the or each other run co-operating with the transfer station and the delivery station. This arrangement permits of using a large number of filler holders without an appreciable increase in length of the machine.

According to a further aspect of the invention the guide for the leaf carrier(s) is formed by a closed path including a straight portion extending parallel to the conveying element of the filler holders. The rectilinear conveying path of the filler holders in conjunction with the rectilinear movement of the leaf carriers provides optimum co-operation and a comparatively simple control of the leaf carrier with respect to the filler holder.

Along the closed path of the conveying elements other stations may be arranged in a simple manner, for example, a pick-up station, where a bobbin having a stock of tobacco leaf portions can be wound off, a gluing station where the wrapper is provided with glue, and, as the case may be, a cleaning station for cleaning the leaf carrier after each wrapping run.

The invention will be described more fully with reference to an embodiment of the device shown schematically in the drawing in a perspective front view.

The device shown comprises ten filler holders 1 all of them fastened to an endless conveying element 2 at equal intervals. The conveying element 2 is passed around two reversing elements 3 and 4 so that a horizontal upper run and a horizontal lower run are formed. The endless element 2 is driven so that the upper run is moved in the direction of the arrow P1.

The device furthermore comprises an even or odd number of carriers 5, only five of which are shown in the FIGURE, said carriers being advanced along an uninterrupted path 6 in the direction indicated by the arrow P2 in order of succession. The leaf carriers 5 may be driven in any suitable manner and it should be noted that the speed of each leaf carrier need not be the same at every point of the path 6. Moreover, in dependence upon the desired leaf shape the leaf carrier may lead or lag with respect to the relevant filler holder 1 with which the carrier co-operates during the wrapping operation.

According to one aspect of the invention part of the path 6 extends parallel to the trajectory to be covered by the filler holders during the wrapping operation, whereas the further part of the path 6 may have any shape. Around the path 6 further stations may be arranged, one of which is shown on the right-hand front side of the FIGURE, where each leaf carrier 5 is provided with a new wrapper. A bobbin holder 7 is provided, the turns of which hold a number of aligned wrappers. The bobbin is wound off a reel 7 so that each time a leaf arrives at the horizontal upper run 8 of the wrapping belt, where the leaf carrier 5 can pick up the leaf portion. As is conventional in the art, as evidenced by U.S. Pat. Nos. 3,542,038 and 4,128,214, the tobacco is stored in stretched condition in the bobbin 7 and the leaf carriers therefore pick up the stretched tobacco and apply it in such condition to the filler. The empty wrapper belt is then wound on a second reel 9. The guiding system of the belt 8 is not shown, since it may be of any suitable shape.

Along the path 6 a gluing station may be disposed for gluing the wrapper on the carrier 5, said station not being shown in the Figure. Moreover, a cleaning station may be provided for cleaning a carrier 5 each time after it has given off a wrapper to the filler.

The device shown in the FIGURE furthermore comprises a transfer station 10 formed in this embodiment by an endless element also passed around at least two reversing elements 11 and 12. The endless element is driven so that its upper run moves with the same speed as the lower run of the endless element 2. The transfer station 10 joins a feeding conveyor 13, which may be of any construction and which is shown in the FIGURE also in the form of an endless element. Above the feeding conveyor 13 a stock container 14 is provided for receiving the fillers to be wrapped.

Opposite the lower run of the endless element 2 a delivery station 15 is arranged at the side of the transfer station 10 for receiving the wrapped products. The ready products arrive at the upper run of a conveying member formed also by an endless element, which transfers them to a delivery conveyor 16, which conveys the ready products to a collecting station 17 for storage in holders 18. This collecting station 17 may be constructed in any desired manner and is not included in the scope of the invention.

The drawing clearly illustrates the idea of the invention: a number—that is to say at least two—filler holders 1 are advanced in order of succession from a transfer station to a delivery station 15 whilst in order of succession along a given length of the path, that is to say, the upper run of the element 2, they co-operate with one or more leaf carriers 5, which are moved in synchronism with the filler holders 1. The continuous feeding process, the subsequent wrapping operation and the subsequent delivery of the ready products guarantee a very important increase in production of each machine.

Other embodiments are possible within the scope of the invention. For example, the filler holders 1 need not be arranged on an endless conveyor belt or rope, since a turntable may also be used. The number of leaf carriers 5 may be chosen arbitrarily and may even be limited to one. The leaf carrier 5 may then be advanced each time by means of a pivotal arm or the like in temporary synchronism with the filler holder 1. The feed of wrappers by means of a bobbin may be constructed in any other appropriate manner. The term tobacco leaf used in this description has to denote both the natural leaf and the synthetic leaf.

What is claimed is:

1. A method of manufacturing cigars, in which each bunch or filler is enveloped with a tobacco leaf portion characterized in that the bunches or fillers are advanced in order of succession along a given length of a path, whilst a tobacco leaf portion is applied in the stretched stae along at least part of said length of path to each advancing bunch or filler and is wrapped around the same.

2. A device for wrapping cigar filler material with a tobacco wrapper portion comprising at least two filler holders for receiving each one filler, and at least one wrapper portion carrier means for applying each tobacco wrapper portion in the stretched state to a filler characterized by a feeding conveyor (13) for feeding fillers from a stock to an adjoining transfer station (10), by a delivery station (15) arranged at a distance from the latter and by an advancing mechanism for carrying the filler holders (1) from the transfer station (10) to the delivery station (15) and conversely as well as by a guide path with a driving mechanism for advancing at least one wrapper portion carrier means in synchronism with the holders (1).

3. A device as claimed in claim 2 characterized in that the holders (1) are arranged on an endless conveying element (2) passed around two reversing members, one run forming said length of the path and the or each further run co-operating with the transfer station (10) and the delivery station (15).

4. A device as claimed in anyone of claim 3 characterized in that the transfer station is formed by an endless conveyor, which is driven with the same speed as the endless conveying element of the filler holders.

5. A device as claimed in claim 3 characterized in that the delivery station is formed by an endless conveying element.

6. A device as claimed in claim 4 characterized in that the delivery station is formed by an endless conveying element.

7. A device as claimed in claim 3 characterized in that the guide means for the wrapper portion carrier(s) is formed by an uninterrupted path having a straight portion extending parallel to the run of the conveying element.

8. A device as claimed in claim 7 characterized in that the transfer station is formed by an endless conveyor, wich is driven with the same speed as the endless conveying element of the filler holders.

9. A device as claimed in claim 7 characterized in that the delivery station is formed by an endless conveying element.

10. A device as claimed in claim 2, 3 or 7 characterized in that said guide path is closed and the device including a pick-up station arranged along the closed path of the wrapper portion carriers for picking up tobacco wrapper portions and a gluing station for applying an adhesive to the tobacco wrapper portion.

11. A device as claimed in claim 10 characterized in that the transfer station is formed by an endless conveyor, which is driven with the same speed as the endless conveying element of the filler holders.

12. A device as claimed in claim 10 characterized in that the delivery station is formed by an endless conveying element.

* * * * *